US006390642B1

(12) United States Patent
Simonton

(10) Patent No.: US 6,390,642 B1
(45) Date of Patent: May 21, 2002

(54) TRACER LIGHT FOR ARCHER'S ARROW

(76) Inventor: Robert Wayne Simonton, 19187 E. Legend Ave., Parker, CO (US) 80134

( * ) Notice: Subject to any disclaimer, the term of this patent is extended or adjusted under 35 U.S.C. 154(b) by 0 days.

(21) Appl. No.: 09/505,109

(22) Filed: Feb. 16, 2000

(51) Int. Cl.[7] ..... F21V 33/00

(52) U.S. Cl. ..... 362/203; 362/253; 362/276; 473/570

(58) Field of Search ..... 362/253, 186, 362/203; 473/585, 570

(56) References Cited

U.S. PATENT DOCUMENTS

| | | | | | |
|---|---|---|---|---|---|
| 3,450,122 | A | * | 6/1969 | Diamond | 124/24.1 |
| 4,340,930 | A | | 7/1982 | Carissimi | 29/47 |
| 4,547,837 | A | | 10/1985 | Bennett | 362/186 |
| 4,704,612 | A | * | 11/1987 | Boy | 342/386 |
| 4,840,383 | A | | 6/1989 | Lombardo | 473/585 |
| 5,058,900 | A | | 10/1991 | Denen | 473/570 |
| 5,134,552 | A | * | 7/1992 | Call | 362/203 |
| 5,141,229 | A | | 8/1992 | Roundy | 359/10 |
| 5,157,405 | A | * | 10/1992 | Wycoff | 342/386 |
| 5,425,542 | A | | 6/1995 | Blackwood | 473/570 |

* cited by examiner

*Primary Examiner*—Sandra O'Shea
*Assistant Examiner*—Hargobind S. Sawhney
(74) *Attorney, Agent, or Firm*—Richard W. Hanes; Hanes & Schutz, P.C.

(57) ABSTRACT

An illuminated archery arrow that includes conventional components such as a tubular shaft, a pointed head attached to the forward end of the shaft, fletchings on the rearward portion of the shaft and a nock at the rear end of the shaft. The arrow structure also includes a novel and improved tail lighting assembly carried interiorly of the rearward portion of the arrow shaft. The lighting assembly comprises a light source disposed in proximity to a light transmitting nock, a battery for powering the light source, a normally open switch responsive to a magnetic field for closing the switch contacts, and other circuit elements that interconnect the battery and the light source. Depending upon the circuit configuration, the battery voltage may be applied intermittently to the light source and then turned off or applied constantly for a specified time and then turned off. The switch contacts are closed by passing the arrow shaft through the field of a magnet attached to the archer's bow in proximity to the path taken by the arrow as it is launched by the bow. When illuminated by the closing of the switch contacts, the light source is visible through the nock, permitting improved visual tracking and locating of the arrow.

10 Claims, 6 Drawing Sheets

TRACER LIGHT FOR ARCHER'S ARROW

The present invention relates generally to archery arrows and more specifically to apparatus that provides a tracer light in the rear end of the arrow so that the arrow's flight may be tracked and its post flight location readily determined.

BACKGROUND

Tracking, finding and identifying an arrow that has been shot from a bow has long been a problem that has confronted archers. Several scenarios create such a problem. When an arrow is shot and misses its intended target it is often difficult to find, especially in a forest or wooded environment. If wind is a factor, it becomes difficult to trace the trajectory and flight path of an ordinary arrow to assess the effect of the wind and to correct for windage on the next shot. When several archers are competitively shooting at the same target it may be impossible to distinguish one arrow from another at shooting distance from the target.

Accordingly, it is the principal object of the present invention to provide an illuminated arrow whose lighted tail end may be turned on by the act of shooting the arrow from a bow.

A second object of the invention is to provide an archer's arrow whose lighted tail end w ill provide tracking throughout the flight of the arrow and will become a beacon for determining the location of the arrow after it has come to rest.

Another object of the invention is to provide a coded light in an archer's arrow that will distinguish one archer's arrow from that of another archer.

The basic concept of illuminating an arrow is not new, as evidenced by a review of prior U.S. patents. However, the present invention constitutes a significant improvement over the illuminated arrows and darts of the prior art which will now be briefly reviewed.

U.S. Pat. No. 4,340,930 for Light Assembly for Archers Arrows uses a normally open electrical circuit to control a lamp nested within the nock of the arrow. A manually operated slide switch closes the circuit to illuminate the lamp. With this arrangement, the light must be manually turned on prior to the shooting of the arrow.

U.S. Pat. No. 4,547,837 discloses a tracer light for an arrow having a battery and a L.E.D which is energized by manually screwing the nock assembly into the aluminum cylinder which houses the electrical circuitry.

U.S. Pat. No. 4,840,383 discloses a dart with fiber optics that conducts light from a forwardly positioned L.E.D. or lamp to illuminate the tail fins of the dart. The light source is turned on and off by a manually operated switch.

U.S. Pat. No. 4,856, 792 teaches an arrow with a chemical light source. The archer activates the light stick by bending it and then inserting the stick into a cavity in the rear end of the arrow, prior to firing the it.

In U.S. Pat. No. 4,989,881 a battery and an L.E.D. are positioned in a recess in the barrel of a dart. The light source is activated by interconnecting the barrel and the point and tail sections of the dart.

U.S. Pat. No. 5,058,900 discloses a general purpose illuminator assembly that responds to acceleration and deceleration of the housing structure to turn the light source on and off.

Similarly, U.S. Pat. No. 5,141,229 utilizes the acceleration and deceleration of an allow body to close a plurality of switches that activate a radio transmitter signal so as to locate the arrow by a directional signal receiver from a remote location.

U.S. Pat. No. 5,425,542 teaches an illuminated dart whose internally mounted light source is activated by a switch that functions by relative movement between the shaft and body of the dart assembly.

In view of this lengthy list of prior art patents directed to illuminated arrows and darts, it is a further object of the present invention to provide a magnetically operated switching device that will turn the light source in the arrow on as the arrow is launched from the bow.

A further object of the invention is to provide an illuminated arrow, dart or similar projectile with circuitry that will control the length of time the taillight remains on or creates a flashing light code that can be used to identify one archer's arrow from that of another.

A still further object of the invention is to provide blinking illumination for an arrow, or other projectile, that can be used to extend the life of the battery that powers the light source in the arrow.

Another object of the invention is to provide a tail end illuminated arrow that contains an aperture in the arrow's nock that significantly improves the visibility of the light in the arrow.

These and other objects, features and advantages of the present invention will become apparent upon a reading of the following detailed description of a preferred form of the invention, taken in connection with the accompanying drawings.

DETAILED DESCRIPTION

Figure 3:
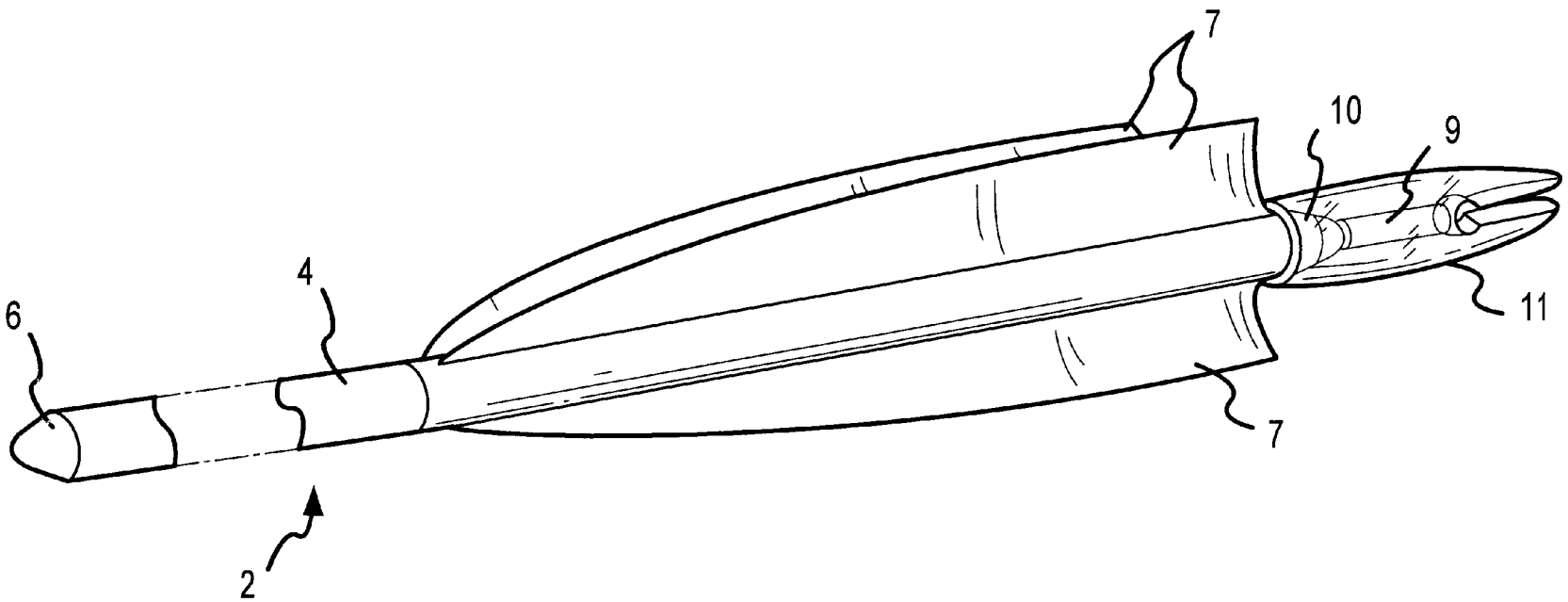
FIG. 3 is a fragmentary view of an arrow of the present invention is its fully assembled form.

As shown in FIG. 3, the fundamental components of an arrow 2 that carries the present invention are conventional, such as the tubular shaft 4, the rearwardly placed fletchings 7 and the pointed forward tip 6. To implement the present invention, a translucent or transparent nock 11 is detachably secured to the rearward end of the arrow shaft 4.

As seen in FIGS. 1, 2, 5 and 6, the lighting assembly of the present invention includes, a light source 10, such as a light emitting diode (LED), a battery 12 (3 Volts) that furnishes the electrical power for the light 10 and interconnecting electrical elements.

Figure 5:
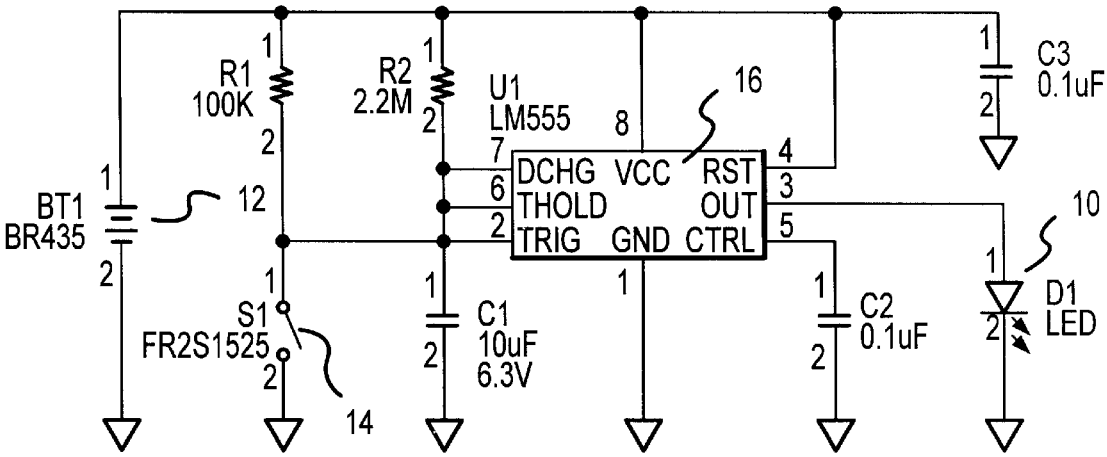
FIG. 5 is a diagram of a fundamental circuit that is mounted on a board inside the arrow shaft to provide switching functions for turning the light on and off.

A circuit for accomplishing the basic purposes of the invention is shown in FIG. 5. Referring to that circuit diagram, the switch 14 is a reed type of magnetic switch that closes momentarily as the switch passes through an activating magnetic field. During the time that the switch 14 is closed the capacitor 40 (5 $\mu$f) discharges through the low resistance of resistor 42 (10 Ω), thus starting the timing process for eventually turning off the light 10. When the switch 14 opens, current flows through the capacitor 40 and resistor 43 (3.3 MΩ) to ground, creating a voltage at the node V1. The 3 volts present at the node V1 causes the Darlington transistor 44 (FMMTA14) to conduct through resistor 47 (10 MΩ) and resistor 45 (1 KΩ), turning on transistor 46 (MMBT2907A), which conducts current from the battery 12 through the light 10 to ground. After the light is initially illuminated the capacitor 40 begins to charge. As it charges the voltage at V1 diminishes until such time as the voltage reaches a level where it no longer will sustain conductivity of the Darlington transistor 44. When transistor 44 turns off, current flow through resistor 45 is terminated and transistor 46 stops conducting current to the light 10, turning it off.

Figure 4:
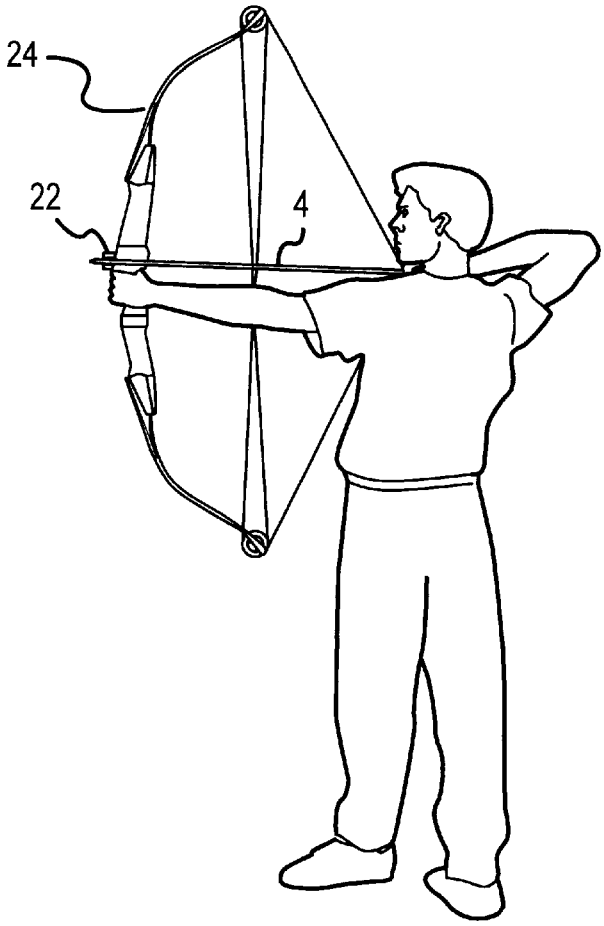
FIG. 4 is a side elevational view of an archer using a bow equipped with a magnet for activating the illumination circuitry in the arrow.
Figure 4A:
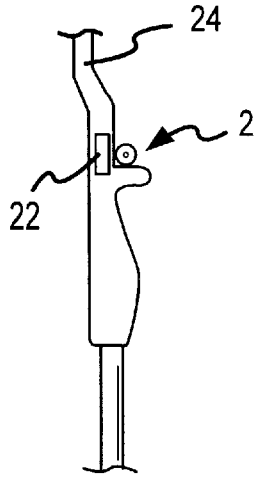
FIG. 4A is a diagrammatic fragmentary front view of a typical bow showing the general relationship between the actuating magnet, mounted on the bow, and the arrow of the present invention.

Thus it is seen that if the magnetic switch 14 is momentarily closed, the light 10 is turned on until the circuit times out and the light is extinguished. Accordingly, the structure of the present invention includes a permanent magnet 22 secured to the riser or handle of the archer's bow 24, in a position proximate to the site on the bow where an arrow is positioned for launching, as generally shown in FIGS. 4 and 4A. When the arrow is launched by the bow, the rearward portion of the arrow's shaft 4 passes through the magnetic field created by the magnet 22, thereby closing the contacts of the control switch 14. The closing of the magnetic reed switch contacts activates the circuitry and turns on the light source 10 which may be observed through the translucent or transparent nock 11 and, more intensely, through the pipe light bore 9 in the nock. Thus, by observing the light in the tail of the arrow, the archer is able to follow the path of the arrow during its flight and more easily locate the arrow after it has fallen to the ground or met its intended target.

Figure 5A:
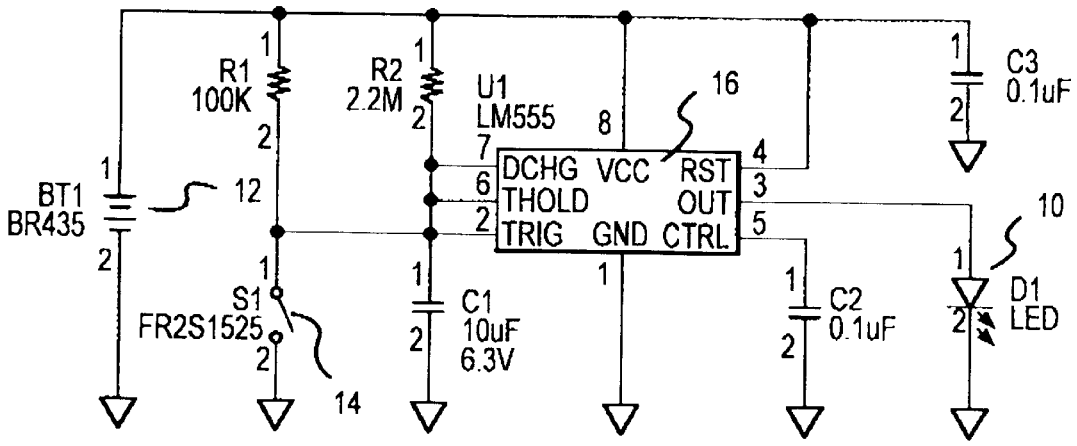
FIG. 5A is a diagram of an alternative circuit that is also mounted on a board inside the arrow shaft to provide switching and blinking functions to the light that provides the illumination.

While many different circuit designs may occur to one skilled in the art, it is appropriate to briefly describe a second embodiment of such a circuit. As shown in FIG. 5A, a microprocessor controller chip 16 is pre-programmed to apply operating voltage to the light source 10 in one of a selectively programmed variety of modes, depending on the mode chosen by the archer and preprogrammed into the chip. The circuit shown in Figure SA is preferred for cyclically applying battery voltage to the light source after the contacts of the switch 14 are momentarily closed for producing a blinking light visible through the translucent nock. For this purpose a PIC 12C508 chip is satisfactory.

In accordance with well known integrated circuit design, the light source may be pre-programmed to pulse or blink in accordance with a predetermined code or it may be made to remain in the constantly illuminated mode until turned off by interrupting the continuity of the electrical path to the light source 10. This interruption may be programmed to occur after the light has remained on a given amount of time by operation of a resistance/capacitance time delay circuit, similar to that shown in the circuit of FIG. 5.

When using the arrow of the present invention with a group of archers, as for example in target shooting, programming the arrows of the various archers to have different light blinking codes will assist the archers in differentiating their respective arrows from a distance. Using a flashing or blinking mode of illumination will also lengthen the life of the battery 12.

The visible illumination provided by the light source 10 may be significantly improved by providing a bore 9 through the longitudinal axis of the nock 11. The bore 9 acts as a light pipe that directly transmits light energy from the light source 10 without all of the light having to be transmitted through the translucent material of which the nock is constructed.

Figure 1:
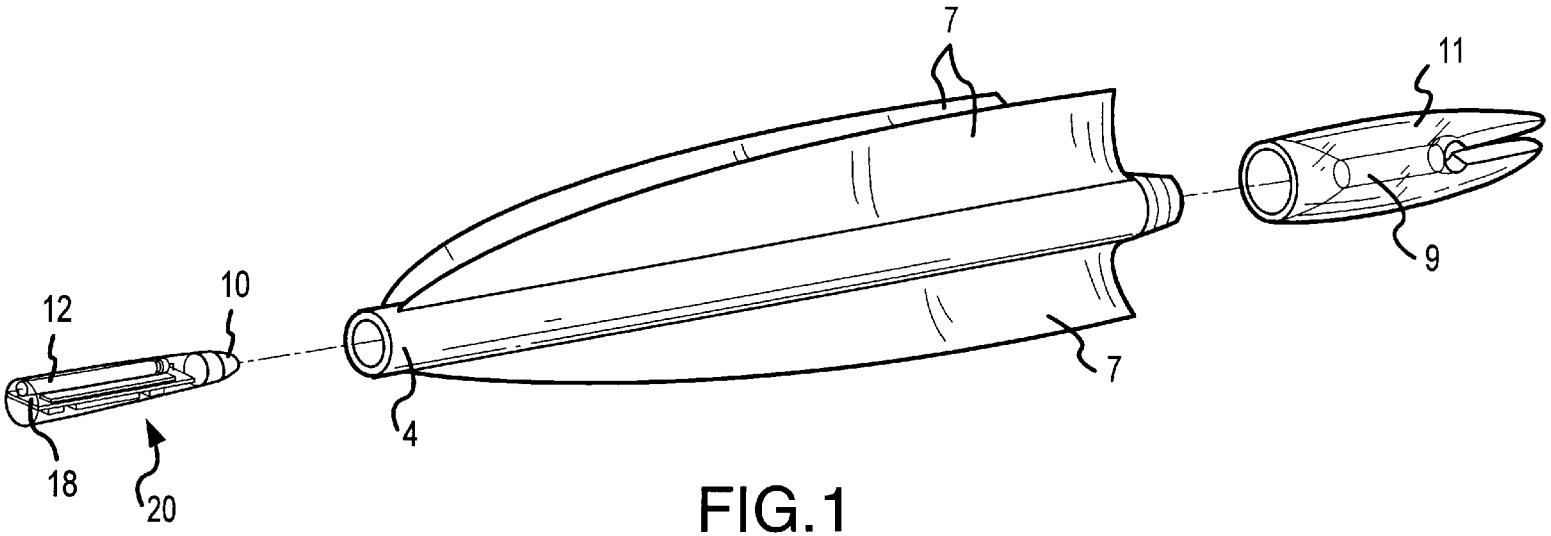
FIG. 1 is an exploded view of the rear portion of an archer's arrow showing the unassembled portions of the lighting assembly. The potted circuitry and light source contains battery that is mounted on the circuit board.

The circuit elements of either FIG. 5 or 5A are mounted on a circuit board 18. FIG. 1 illustrates an embodiment of the assembly where the elongated battery 12 is mounted parallel to and in close proximity to the circuit board 18. The light source 10 is mounted at the end of the circuit board 18 that is proximate to the nock when the assembly is installed in the arrow shaft. The entire assembly is potted in epoxy or similar material in order to stabilize the circuit elements and to form a compact module 20 for insertion into the interior of the rearward portion of the arrow shaft 4. The module 20 may be glued or otherwise attached to the interior of the arrow shaft, however the attachment should not be so permanent that the module can not be replaced when the battery is run down. It is also desirable that the circuit elements within the module 20 be balanced about the longitudinal axis of the module so as not to unbalance the arrow itself.

Figure 2:
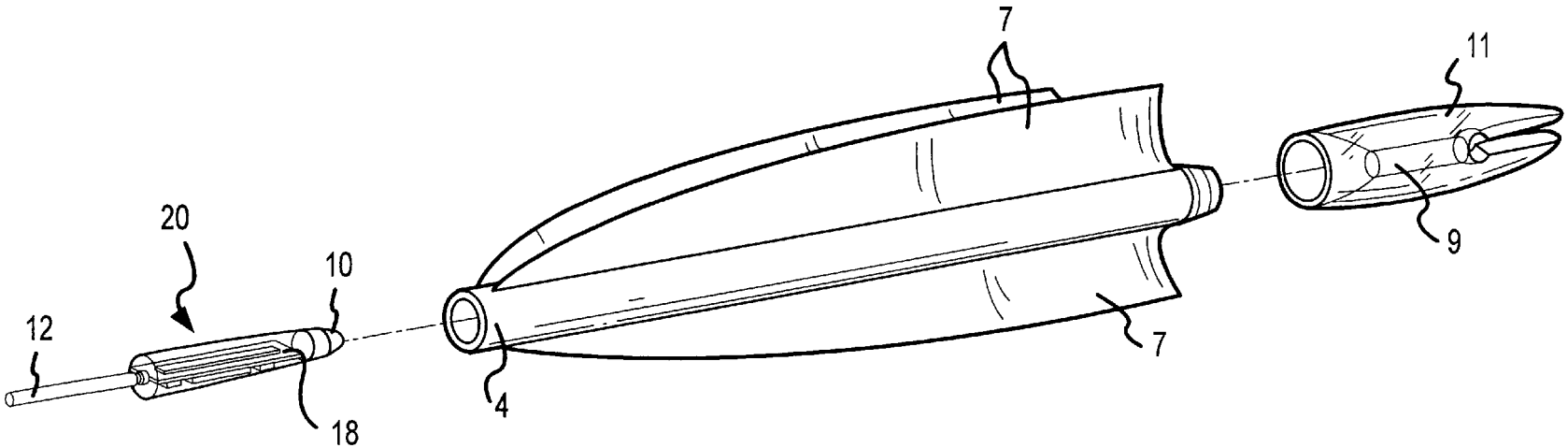
FIG. 2 is an exploded view of the rear portion of an archer's arrow showing the unassembled portions of the lighting assembly. In this embodiment, the battery is mounted at the front of the potted circuit board and in longitudinal alignment therewith.

A second embodiment of the module is shown in FIG. 2, where the battery 12 is attached to the forward looking end of the circuit board 18. The battery 12 is thus positioned coaxially with the longitudinal axis of the module 20 making the balance of the module easier to obtain.

Figure 6:
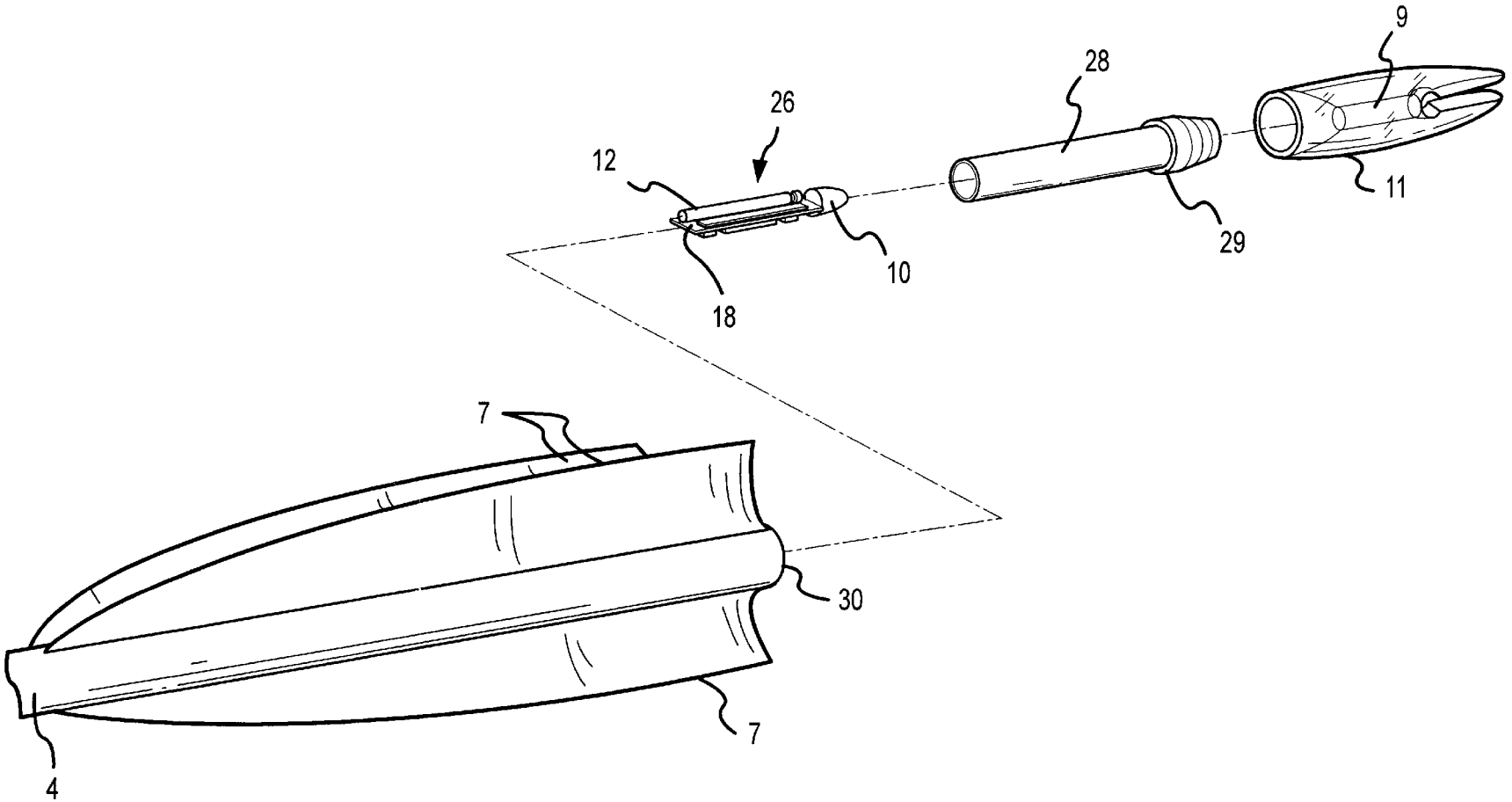
FIG. 6 is an exploded perspective view of an alternative mounting arrangement for the battery, circuit board and light of the illumination assembly of the present invention.

A third embodiment of the invention is illustrated in FIG. 6. Here the battery 12 is not potted with the circuit board and may therefor be separately replaced. In this version of the invention a module 26 is inserted into a tubular sleeve 28. The outside diameter of the sleeve's tubular section is enough smaller than the inside diameter of the arrow shaft 4 to easily nest telescopically inside the arrow shaft. A boss 29 at the rear end of the sleeve abuts against the end 30 of the arrow shaft 4, thus preventing the sleeve from moving further into the interior of the shaft. The sleeve can be screwed into the arrow shaft if appropriate mating threads are provided on the exterior of the sleeve and the interior of the arrow shaft. Otherwise, a touch of glue will cement the sleeve to the arrow shaft until the glued connection is broken for purposes of replacing the battery 20 or the complete module 26. The main advantage of this embodiment is that removing the sleeve and the module 26 for battery replacement, or other purpose, is rendered easier than in the embodiment of FIGS. 1 and 2.

I claim:

1. An illuminated archery arrow comprising, a shaft having forward and rearward portions and being at least partially tubular in the rearward portion, a light transmitting nock attached to the rearward end of the shaft, a lighting assembly carried interiorly of the rearward portion of the shaft and comprising, a light source disposed in proximity to the nock so that the light source is visible through the nock, a battery for providing a voltage to the light source, a switch, having normally open electrical contacts, and including means responsive to a magnetic field for closing the switch contacts, at least momentarily, and circuit means interconnecting the battery, the switch and the light source for applying, for at least a limited period of time, battery voltage to the light source after the switch contacts are closed, wherein said circuit means includes means for cyclically interrupting the application of battery voltage to the light source after the switch contacts are: closed, in accordance with a pre-programmed code, for producing a blinking light visible through the nock.

2. The combination of claim 1 wherein the circuit means includes means for interrupting the application of battery voltage to the light source as a function of elapsed time, measured from the magnetically provoked closing of the switch contacts.

3. The combination of claim 1 wherein the nock includes a longitudinal bore therethrough.

4. The combination of claim 1 wherein at least the switch and circuit means are potted into an elongated cylindrically shaped module that is disposed within the hollow interior of the rearward portion of the arrow shaft and where the light source is disposed rearwardly of the module, also within the hollow interior of the shaft.

5. The combination of claim 4 wherein the battery is disposed within the hollow interior of the rearward portion of the shaft, exteriorly of the cylindrically shaped module and coaxially with the longitudinal axis of the shaft.

6. The combination of claim 4 wherein the switch and circuit means are mounted on a circuit board and the battery is disposed in a side by side relation with the circuit board within the elongated cylindrically shaped module.

7. A combination archer's bow and an illuminated arrow for use therewith comprising, a shaft having a forward and rearward portion and being at least partially tubular in the rearward portion thereof, a light transmitting nock having a longitudinal bore therethrough and attached to the rearward end of the shaft, a lighting assembly carried interiorly of the rearward portion of the shaft and comprising, a light source disposed in proximity to the nock permitting the light source to be visualized through the nock and the bore in the nock, a battery, including a source of voltage and power, a switch, having normally open electrical contacts, and including means responsive to a magnetic field for closing the switch contacts, circuit means, including capacitive, resistive and transistor means, interconnecting the battery, the switch and the light source for applying the battery's voltage to the light source after the switch contacts are closed, at least momentarily, a bow having a site in which an arrow is placed for launching, and a magnet having a magnetic field and attached to the bow in proximity to the site so that the arrow shaft will pass through the magnetic field as the arrow is being launched from the bow.

8. The combination of claim 7 and further including means for cyclically applying battery voltage to the light source after the switch contacts are closed, in accordance with a preprogrammed sequence.

9. The combination of claim 7 wherein the circuit means also includes means for interrupting the application of battery voltage to the light source as a function of elapsed time, measured from the magnetically provoked closing of the switch contacts.

10. The combination of claim 7 and further including a sleeve member having an interior space in which the lighting assembly is disposed, said sleeve member being nested within the rearward portion of the shaft.

* * * * *